US005957386A

United States Patent [19]

Bialke

[11] Patent Number: 5,957,386

[45] Date of Patent: Sep. 28, 1999

[54] MULTI-PATH SPRAY GUN

[75] Inventor: Noel M. Bialke, St. Francis, Minn.

[73] Assignee: Master Coating Technologies, Inc., Eagan, Minn.

[21] Appl. No.: 08/958,109

[22] Filed: Oct. 27, 1997

[51] Int. Cl.[6] ..... B05B 1/28

[52] U.S. Cl. ..... 239/291; 239/314; 239/422; 239/526

[58] Field of Search ..... 239/288, 288.3, 239/288.5, 290, 291, 294, 296, 310, 311, 314, 318, 422, 428, 433, 600, 525, 526, 583; 118/315

[56] References Cited

U.S. PATENT DOCUMENTS

| | | | |
|---|---|---|---|
| 3,033,472 | 5/1962 | Shelton-V | 239/422 |
| 3,135,467 | 6/1964 | Greenman | 239/304 |
| 3,178,118 | 4/1965 | New | 239/422 |
| 3,179,341 | 4/1965 | Plos et al. | 239/311 |
| 3,672,570 | 6/1972 | Scarbrough et al. | 239/70 |
| 4,795,096 | 1/1989 | Smith | 239/288.3 |
| 4,927,079 | 5/1990 | Smith | 239/11 |
| 5,474,235 | 12/1995 | Cole et al. | 239/431 |
| 5,571,562 | 11/1996 | Wakat | 427/280 |

*Primary Examiner*—Andres Kashnikow
*Assistant Examiner*—Lisa Ann Douglas
*Attorney, Agent, or Firm*—Westman, Champlin & Kelly, P.A.

[57] ABSTRACT

A multi-path spray gun includes a body and a manifold. The body is couplable to a source of pressurized air. The manifold is coupled to the body to receive the pressurized air, and is also simultaneously couplable to a plurality of fluid sources to receive fluids. The manifold is adapted to direct the fluids and pressurized air such that pieces of the fluids are propelled by the air in a non-atomized manner.

13 Claims, 7 Drawing Sheets

MULTI-PATH SPRAY GUN

INCORPORATION BY REFERENCE

U.S. Pat. No. 5,571,562 to Wakat, issued Nov. 5, 1996 is hereby fully incorporated by reference.

BACKGROUND OF THE INVENTION

The present invention relates to spraying systems. More particularly, the present invention relates to an improved multi-path spray gun.

In the field of paint and wall coating application, it is sometimes desirable to apply multiple paints to a surface without mixing the paints. For example, providing various paints of different colors to a surface can create a multi-colored speckled surface. Further, with minor adjustments, many different effects can be created. Thus, multi-path paint application can create a variety of aesthetically pleasing surfaces and/or effects. Traditionally, however, such applications required multiple successive paint applications which was an extremely labor intensive process.

More recently, in U.S. Pat. No. 5,571,562 Wakat disclosed a method and apparatus for simultaneously applying multiple paints to a surface without mixing the paints with one another. The system of Wakat provided significant time savings by configuring three sprayers into a multiple-path spray gun such that the paints would not atomize or mix with one another. However, a need still exists to provide a more convenient and efficient multi-path spray gun.

SUMMARY OF THE INVENTION

A multi-path spray gun includes a body and a manifold. The body is couplable to a source of pressurized air. The manifold is coupled to the body and adapted to receive the pressurized air. The manifold is also simultaneously couplable to a plurality of fluid sources to receive fluids. The manifold is adapted to direct the fluids and pressurized air such that pieces of the fluids are propelled by the air in a non-atomized manner.

DETAILED DESCRIPTION OF THE PREFERRED EMBODIMENTS

Figure 1:
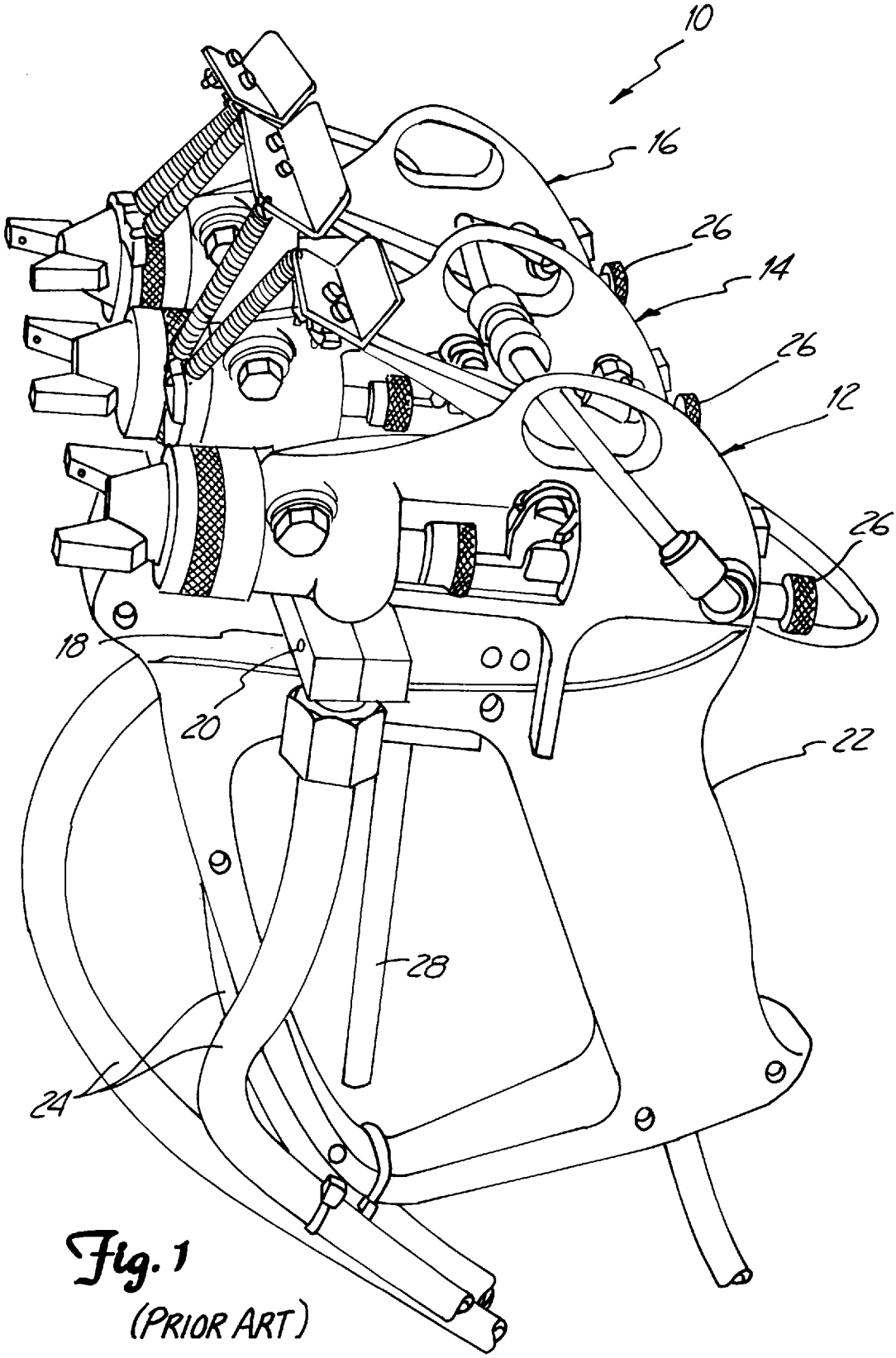
Fig. 1 (PRIOR ART)
FIG. 1 is a diagrammatic view of multi-path spray gun 10 in accordance with the prior art.

A multi-path spray gun of the type disclosed by Wakat is shown in FIG. 1. Individual spray units 12, 14, and 16 are attached to mount 18 such that they are rotatably adjustable thereon and such that their rotational displacement can be fixed by set screws such as set screw 20. Additionally, a handle 22 is fixed to mount 18 such that a user can manipulate all three spray guns with handle 22. In a known manner, fluid supply lines 24 are provided to the individual spray units 12, 14, 16. Fluid needle stops 26 adjust fluid flow rates through individual spray units such that the amount of fluid propelled by each individual spray unit 12, 14, 16 can be individually adjusted. A trigger 28 is also provided which is coupled to the fluid flow needle of each individual spray unit. Actuation of trigger 28 causes simultaneous fluid flow through all individual spray units.

While Wakat represents a significant advancement in the art, the present invention provides many advantages over the device of Wakat which can be better understood in view of some of the limitations of Wakat's device. The cumulative air requirement of the three spray units of the Wakat device is such that an air valve is generally not feasible for valving the air. Thus, the multi-path spray gun of Wakat has continuous air flow which creates an air demand in excess of that which can be provided by some air compressors commonly used by those in the industry. As a result, special high capacity air compressor equipment is required to operate the multi-path spray gun of Wakat. The present invention utilizes compressed air more efficiently than the prior art, and as a result standard air compressor equipment may now be utilized for operating multi-path spray equipment.

It can be seen in FIG. 1 that essentially three individual spray units are provided. Thus, multi-path spray gun 10 depicted in FIG. 1 weighs approximately three times more than a standard, single nozzle spray gun. This weight increase may fatigue users spraying paint for extended periods of time. The present invention provides miniaturization advantages that will likely reduce user fatigue.

As disclosed by Wakat, the two outer spray guns 12, 16 are angled inwardly in order to create a focal point. Thus, to some extent air is provided by guns 12 and 16 with components of motion in opposite directions such that the full efficiency of the air used in propelling the paint to the wall surface is not realized. The present invention provides parallel air motion such that opposing motion components are virtually eliminated. Finally, the present invention provides disassembly and cleaning advantages which are not present in the device of Wakat, which advantages will be discussed later in the specification.

Figure 2:
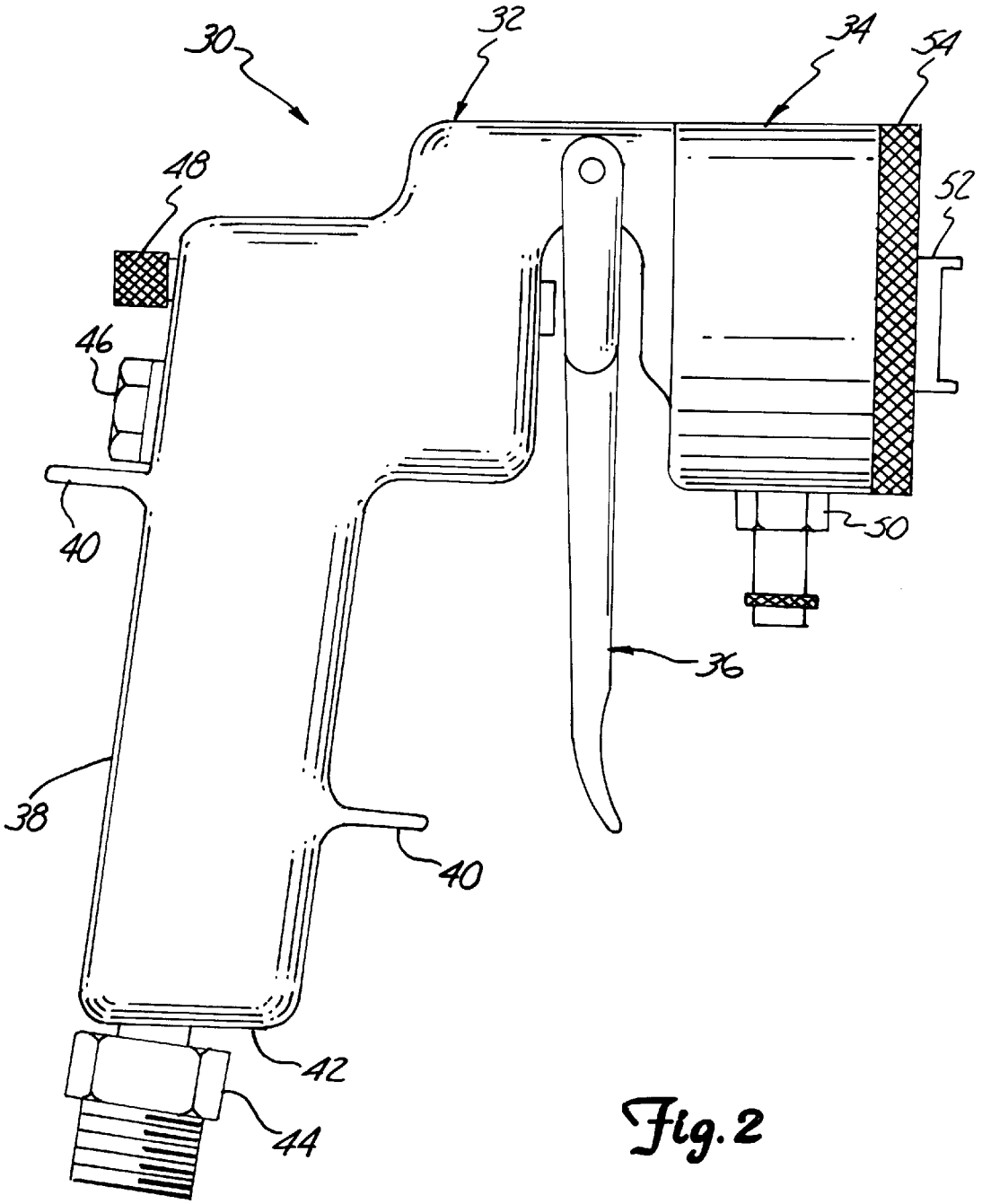
FIG. 2 is a side elevation view of multi-path spray gun 30 in accordance with the present invention.

FIG. 2 is a side elevation view of improved multi-path spray gun 30 in accordance with the present invention. Spray gun 30 includes body 32, manifold 34, and trigger 36.

Body 32 includes handle portion 38 which is suitable for grasping by a user, and angled slightly from vertical to provide ergonomic benefits. Additionally, body 32 also includes hand guards 40 which reduce the likelihood that the user's hand will slide upwardly on body 32 while using spray gun 30. Handle portion 38 is hollow, and defines a chamber therein which extends upwardly from bottom portion 42. Connector 44 is coupled to handle portion 38 at bottom portion 42 and fluidically communicates with the hollow chamber within handle portion 38. Coupler 44 is preferably a quick disconnect type coupler of the type known (but not used) in the art and commercially available.

Body 32 also includes air valve cap 46 which is disposed on a rear portion of body 32 above one of guards 40. Additionally, a plurality of fluid adjustment screws 48 are provided proximate air valve cap 46 on body 32. Preferably, fluid adjustment screws 48 are knurled in order to facilitate user adjustment thereof.

Manifold 34 is coupled to body 32, and includes couplers 50 which are adapted to couple to fluid sources. Preferably, couplers 50 are adapted to couple via quick-connections to fluid sources providing fluid under pressure. The fluid sources are preferably conventional and known in the art.

Air cap 52 is coupled to manifold 34 in an hermetically sealed fashion by air cap retaining nut 54. Preferably, air cap retaining nut 54 is knurled to facilitate disassembly by a user without the necessity of specialized tools.

Trigger 36 is rotatably coupled to body 32 and engages fluid valves (not shown in FIG. 2) and an air valve 56 (not shown in FIG. 2) to activate paint application upon rotation toward handle portion 38.

Figure 3:
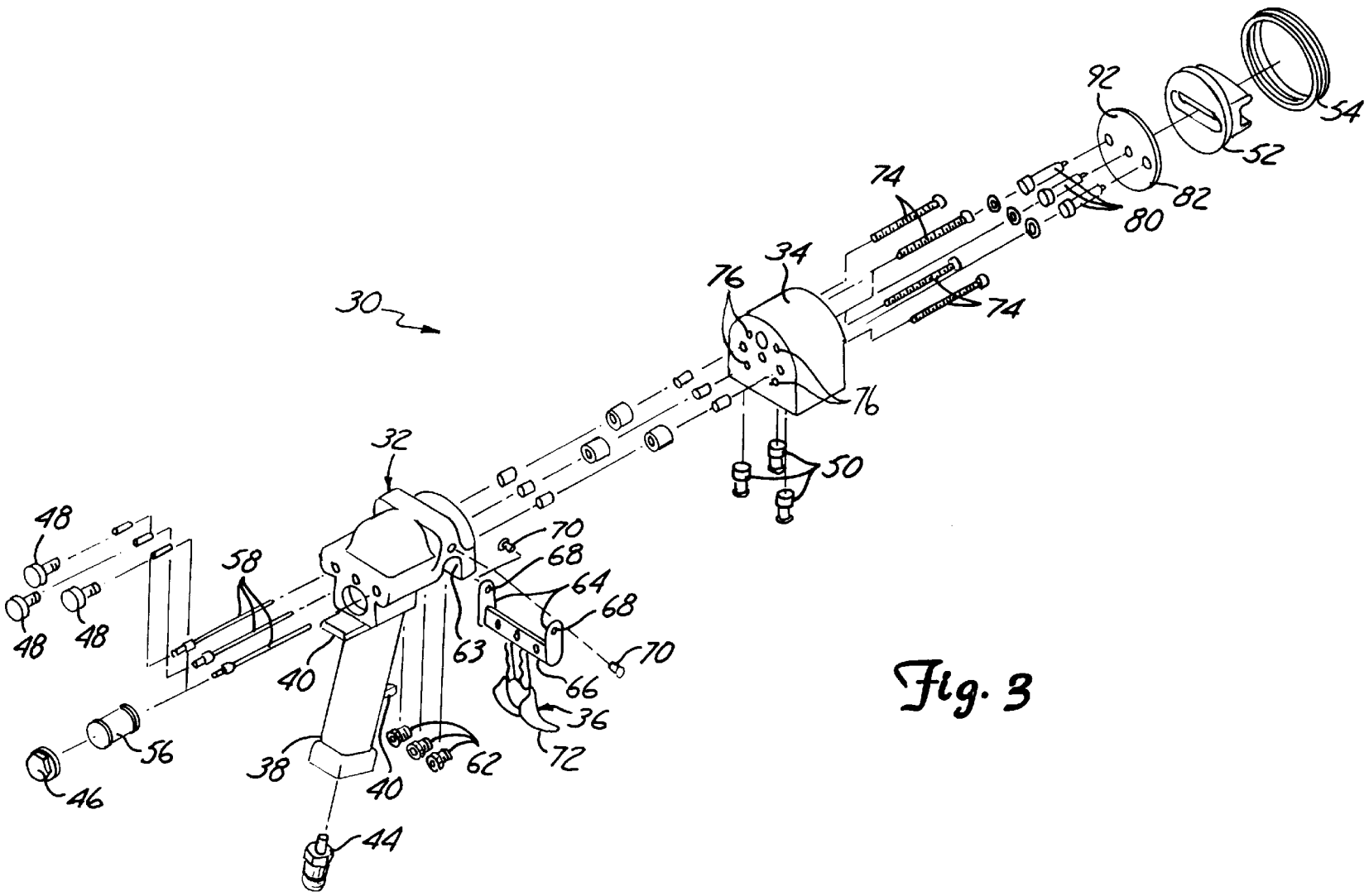
FIG. 3 is an exploded perspective view of multi-path spray gun 30 in accordance with the present invention.

FIG. 3 is an exploded perspective view of multi-path spray gun 30 in accordance with the present invention. As can be seen in FIG. 3, air valve retaining nut 46 retains air valve 56 within body 32. Additionally, it can be seen in FIG. 3 that fluid adjustment screws 48 are coupled to respective needle valves 58 which extend through body 32 into manifold 34 to control fluid flow through manifold 34. As can also be seen, fluid valve contactors 62 are disposed within notch 63 of body 32.

Trigger 36 includes a pair of side portions 64 which are connected together by cross-member 66. Each of side portions 64 includes a mounting hole 68 through which mounting hardware 70 traverses. Trigger member 72 is coupled to cross-member 66 such that displacement of trigger member 72 causes trigger 36 to pivot about mounting holes 68. Trigger 36 is rotatably coupled to body 32 with mounting hardware 70 such that trigger 36 rotates with respect to body 32. It should be noted however, that the present invention could be practiced with trigger 36 rotatably mounted to manifold 34 instead of body 32 or in any other suitable arrangement.

As can be seen in FIG. 3, manifold 34 is secured to body 32 by screws 74 which pass through mounting holes 76 in manifold 34 and anchor in body 32. Within manifold 34, fluid nozzles 78 are fluidically coupled to respective fluid connectors 50 via fluid seals 80. Fluid nozzles 78 are fixed to air distributor 82 such that a portion of fluid nozzles 78 pass through air distributor 82. Preferably, fluid nozzles 78 are press fit into air distributor 82. Other means of attaching fluid nozzles 78 to air distributor 82 may be used as long as the result is an hermetic seal. Air distributor 82 couples to air cap 52 in a manner which will be described in greater detail later in the specification. Air cap retaining nut 54 retains air distributor 82 and air cap 52 such that air distributor 82 and air cap 52 are hermetically sealed to manifold 34.

Figure 4A:
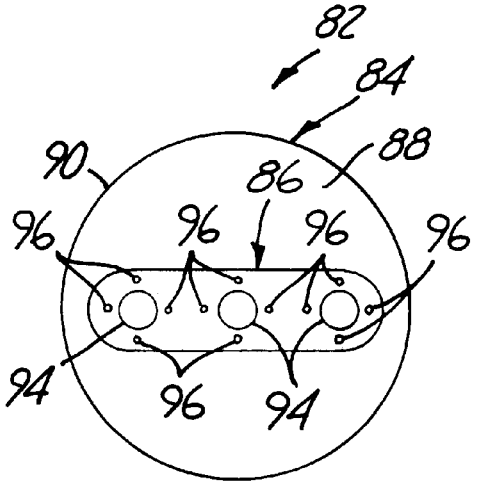
FIG. 4A is a front elevation view of manifold 82 in accordance with the present invention.
Figure 4B:
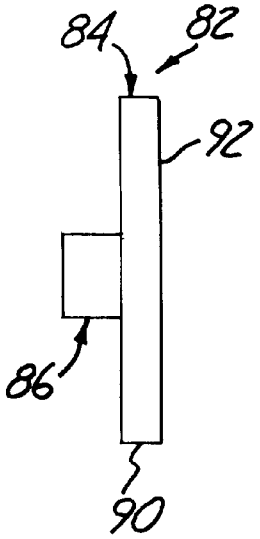
FIG. 4B is a side elevation view of manifold 82 in accordance with the present invention.

FIGS. 4A and 4B are front and side elevational views of air distributor 82, respectively. Air distributor 82 includes disc portion 84 and raised portion 86.

Disc portion 84 of air distributor 82 further includes front surface 88, circumferential sidewall 90 and rear surface 92 opposite front surface 88.

Raised portion 86 of air distributor 82 is preferably of an elongated curved shape and extends away from front surface 88. Raised portion 86 defines a plurality of nozzle holes 94 which are adapted to receive fluid nozzles 78 in a hermetically sealed fashion. Nozzle holes 94 extend through air distributor 82 preferably perpendicular to rear surface 92. Manifold 82 also defines a plurality of air passageways 96 which extend through air distributor 82 preferably parallel to nozzle holes 94.

Figure 5C:
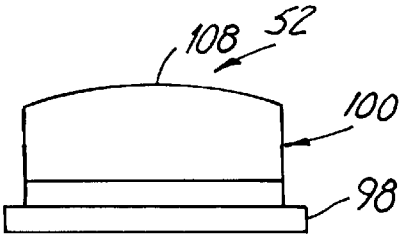
FIG. 5C is a top plan view of air cap 52 in accordance with the present invention.
Figure 5A:
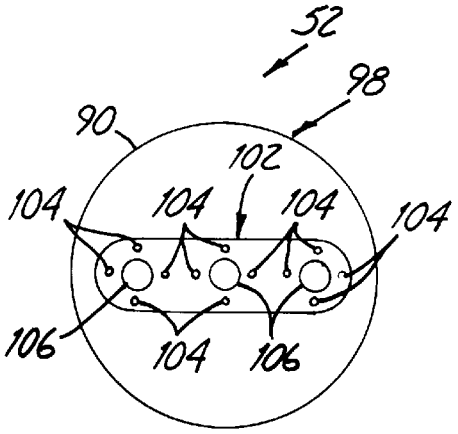
FIG. 5A is a front elevation view of air cap 52 in accordance with the present invention.
Figure 5B:
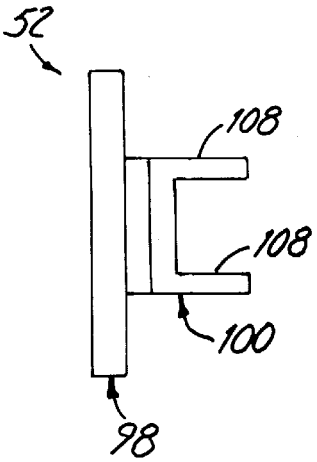
FIG. 5B is a side elevation view of air cap 52 in accordance with the present invention.

FIGS. 5A, 5B, and 5C are rear elevation, side elevation, and top plan views of air cap 52, respectively. Air cap 52 includes a disc portion 98 and applicator portion 100 which together define slot 102. Slot 102 is adapted to sealably receive raised portion 86 of air distributor 82. Air cap 52 defines cap air passageways 104 which extend through air cap 52 and which couple to air holes 94 in air distributor 82. Air cap 52 also defines fluid nozzle holes 106 which are adapted to receive ends of fluid nozzles 78. Air cap 52 is shown with four air passageways 104 disposed about each fluid nozzle hole 106. It should be noted that any appropriate number of fluid passageways and air passageways may be used, but increasing the number of air passageways increases the air demand of the spray gun. However, although more air passageways increase the air demand of the gun, the increase provides faster paint application. In addition, air cap 52 can be used with no air passageways if fluid nozzle holes 106 are sized sufficiently larger than the tips of the fluid nozzles, such that a gap exists between each fluid nozzle tip and hole 106. Air will then flow through the gap to propel the fluid. Thus, fluid is extruded through nozzle holes 106 by fluid nozzles 78 which fluid then encounters air which exits air cap 52 at a 5 relatively high velocity thereby propelling (but not atomizing) the extruded fluid to the surface. Air cap 52 also includes a plurality of protective rails 108 which extend from air cap 52 and protect the fluid nozzles in the event that the spray gun of the present invention is dropped.

Figure 6A:
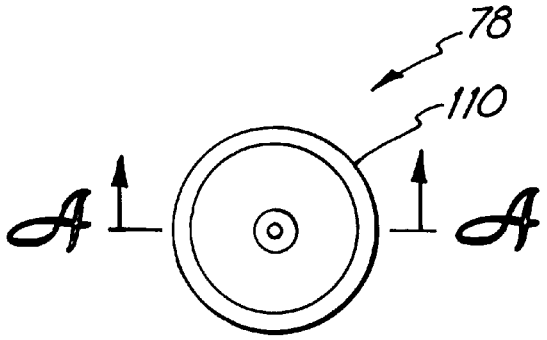
FIG. 6A is a top plan view of fluid nozzle 78 in accordance with the present invention.

FIG. 6A is a top plan view of fluid nozzle 78 in accordance with the present invention. As can be seen in FIG. 6A, fluid nozzle 78 includes a plurality of ribs 110 disposed about fluid nozzle 78.

Figure 6B:
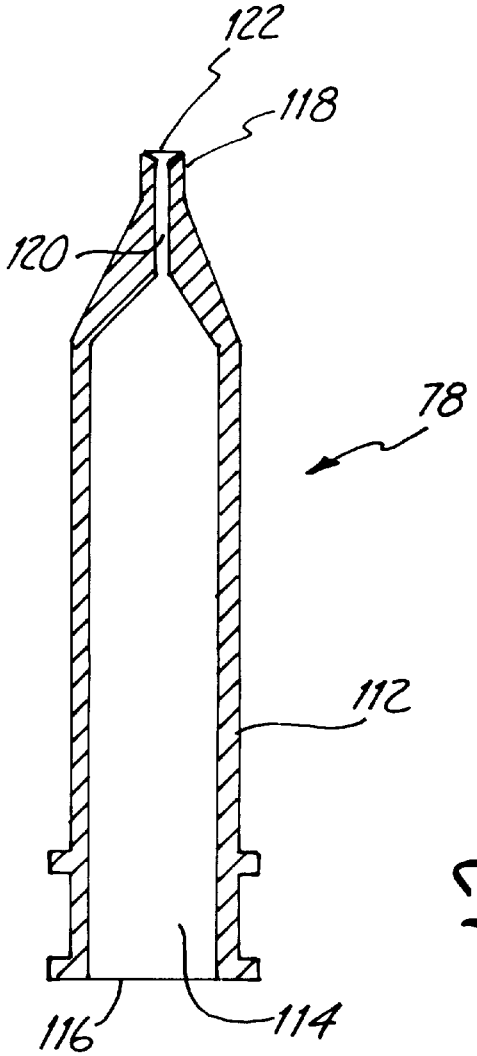
FIG. 6B is a sectional elevation view of fluid nozzle 78 in accordance with the present invention.

FIG. 6B is a section view taken from section A—A in FIG. 6A of fluid nozzle 78 in accordance with the present invention. Fluid nozzle 78 includes circumferential sidewall 112 which defines a fluid chamber 114 therein. Further, fluid nozzle 78 includes base end 116 and nozzle end 118. Base end 116 is adapted to fluidically couple to manifold 34 via fluid seal 80 to receive fluid thereby. Fluid chamber 114, proximate nozzle end 118, tapers down to narrow fluid passageway 120. Fluid passageway 120 extends from fluid chamber 114 to tip 122 of fluid nozzle 78. Proximate tip 122, fluid passageway 120 flares outward. The flaring of fluid passageway 120 proximate tip 122 causes fluid traveling through fluid passageway 120 to conform to the flared sidewalls of fluid passageway 120 thus causing the fluid to become less coherent, and essentially break up into smaller portions. Preferably, the flared portion of fluid passageway 120 is flared at an angle of about 600 from the longitudinal axis of fluid passageway 120. However, it should be noted that any appropriate angle may be used. Additionally, it is preferred that fluid nozzle 78 is constructed from stainless steel and coated with a corrosion-resistant, non-stick composition. As is known in the art, a combination of nickel, and a non-stick material such as Teflon manufactured by Dupont, provides a suitable surface to which paint will not readily adhere, thus facilitating fluid flow.

Figure 7:
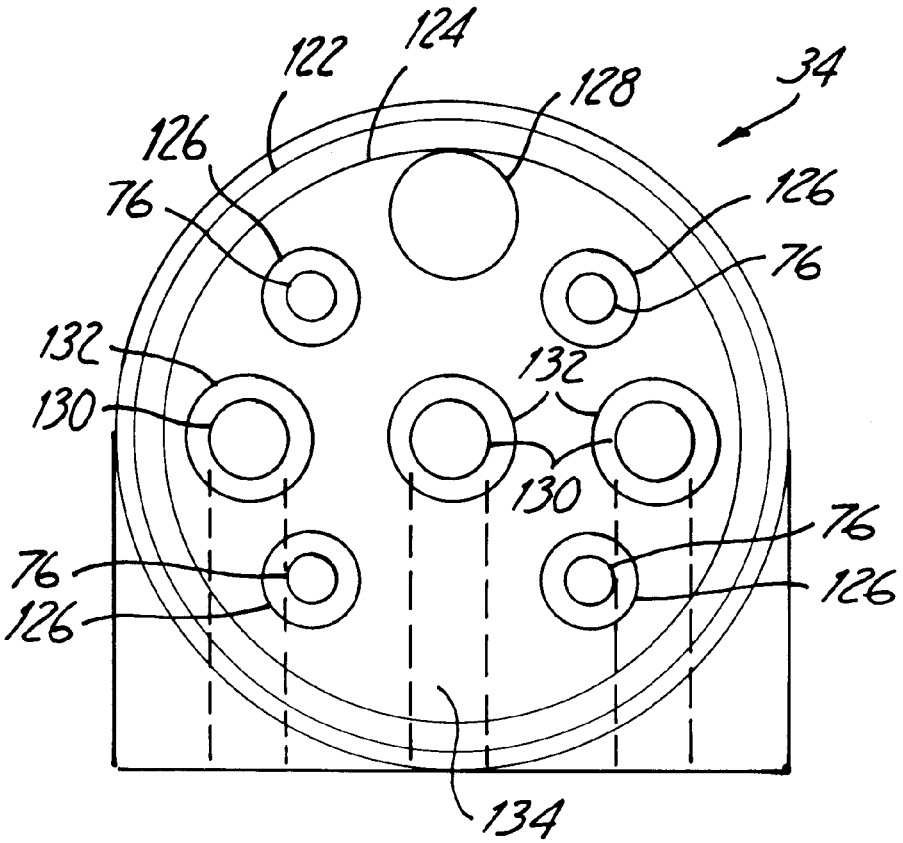
FIG. 7 is a front elevation view of manifold 34 in accordance with the present invention.

FIG. 7 is a front elevation view of manifold 34 in accordance with the present invention. Manifold 34 includes outer sidewall 122, ridge 124, mounting holes 76, relief holes 126, air passageway 128, fluid passageways 130 and fluid nozzle receptacles 132. Outer sidewall 122 is externally threaded in order to threadably receive air cap retaining nut 54 which is suitably internally threaded. Within manifold 34, rim 124 is spaced apart from surface 134 in a direction away from body 32. The inside diameter of sidewall 122 and the inside diameter of rim 124, are selected such that manifold 82 and air cap 52 fit within sidewall 122 and are supported by rim 124. Air passageway 128 is coupled to an air pressure source through body 32, air valve 56, and connector 44. Air distributor 82 and air cap 52 are retained in manifold 34 by air cap retaining nut 54 to such an extent that air distributor 82 hermetically seals against rim 124. Thus, upon actuation of trigger 36, air valve 56 opens and provides air pressure to air passageway 128 thereby pressurizing an air chamber defined by rim 124, surface 134, and rear surface 92 of air distributor 82. The only passageways which are not hermetically sealed and through which pressurized air in the air chamber must flow, are air passageways 96 in air distributor 82 and cap air passageways 104 in air cap 52.

Screws 74 extend through mounting holes 76 to sealably attach manifold 34 to body 32. Additionally, screws 74 seat within relief holes 126 such that screws 74 are disposed at or behind surface 134.

Fluid passageways 130 are coupled to fluid connectors 50 in manifold 34 (shown in FIG. 3). Each fluid passageway 130 receives fluid from a corresponding connector 50. Fluid nozzles holes 132 are adapted to sealably receive base portions 116 of fluid nozzles 78 to manifold 34. Thus, upon actuation of air valve 56, pressurized air is prevented from seeping into fluid passageway 130.

Providing all spray paths within a single unit allows for significant miniaturization. The multi-path spray gun of the present invention is lighter than multi-path spray guns of the prior art. Such weight reduction allows users of the present invention to paint more surface area without succumbing to fatigue than users of multi-path spray guns of the prior art.

Additionally, providing all paths within a smaller, unitary housing allows for parallel fluid paths. Parallel fluid paths were not readily feasible in the prior art because the size of individual guns required path spacing to be larger than the path spacing of the present invention. The relatively larger path spacing of the prior art necessitated the outer guns to be angled inwardly in order to create a focal point upon which all fluid paths converged. Because the paths of the present invention are preferably parallel, the present invention operates with very little cancellatory components in the air motion. As a result, air is used more efficiently than devices of the prior art.

With the increase of air efficiency, it is possible to valve the pressurized air with a single high-flow air valve, so that the gun does not draw air when trigger 36 is not actuated. The air valve, and the efficient manner in which air is employed, reduces air demand to such an extent that conventional air compressor equipment may be used as a source of pressurized air for guns of the present invention.

Additionally, the present invention is preferably provided with quick-connects for air and fluid connections. For further convenience, fluid adjustment knobs 48 and air cap retaining nut 54 are preferably knurled in order to allow those components to be adjusted by hand. Thus, the multi-path spray gun of the present invention can be disconnected both pneumatically and fluidically, and partially disassembled, all by hand.

In conclusion, the present invention provides many advantages over the prior art. The various advantages provide a multi-path spray gun which is relatively more convenient for users, and which provides higher efficiency.

Although the present invention has been described with reference to preferred embodiments, workers skilled in the art will recognize that changes may be made in form and detail without departing from the spirit and scope of the invention. For example, although the present invention has been described with respect to three fluid paths, the present invention can also be practiced with two fluid paths, or any other suitable number of fluid paths.

What is claimed is:

1. A multi-path spray gun comprising:

a body couplable to a source of pressurized air;

a manifold coupled to the body, receiving the pressurized air, simultaneously couplable to a plurality of fluid sources to receive a plurality of fluids thereby, and adapted to direct the plurality of fluids and pressurized air such that pieces of the fluids are propelled by the air in a non-atomized manner;

a plurality of fluid nozzles fluidically coupled to the respective fluid sources through the manifold; and an air distributor coupled to the manifold in hermetically sealed fashion, the air distributor having a plurality of fluid passageways receiving the plurality of fluid nozzles in hermetically sealed fashion, the air distributor also defining a plurality of air passageways extending through the air distributor, and disposed about each fluid passageway, the air passageways communicating with the air source through the manifold and the body.

2. The multi-path spray gun of claim 1 and further comprising an air cap coupled to the air distributor in hermetically sealed fashion, the air cap defining a plurality of cap holes adapted to receive the fluid nozzles, the air cap further adapted to direct air from the air distributor to propel pieces of fluid exiting the fluid nozzles away from the multi-spray gun.

3. The multi-path spray gun of claim 2 wherein each fluid nozzle has a diameter, and each respective cap hole is sized larger than the respective diameter of the fluid nozzle such that a gap exists therebetween.

4. The multi-path spray gun of claim 2 wherein the air cap defines a plurality of air holes disposed about each cap hole the air holes extending through the air cap.

5. The multi-path spray gun of claim 4 wherein the air holes disposed about the cap holes, are spaced equally thereabout.

6. The multi-path spray gun of claim 5 wherein the fluid nozzles are aligned in a plane and wherein the fluid cap includes a plurality of guard rails extending from the air cap.

7. The multi-path spray gun of claim 6 and further comprising an air cap retaining nut threadably engageable with the manifold to couple the air distributor and the air cap to the manifold in hermetically sealed fashion.

8. The multi-path spray gun of claim 7 wherein the air cap retaining nut includes an outer circumferential surface which is knurled.

9. A multi-path spray gun comprising:

a body couplable to a source of pressurized air;

a manifold coupled to the body, receiving the pressurized air, simultaneously couplable to a plurality of fluid sources to receive a plurality of fluids thereby, and adapted to direct the plurality of fluids and pressurized air such that pieces of the fluids are propelled by the air in a non-atomized manner; and a plurality of fluid valves coupled to the manifold and adapted to be coupled to the respective fluid sources to selectively allow fluid flow through the manifold.

10. The multi-path spray gun of claim 9 and further comprising a trigger coupled to the plurality of fluid valves such that trigger actuation activates all fluid valves in unison.

11. The multi-path spray gun of claim 10 and further comprising an air valve coupled to the body to selectively allow air flow from the source of pressurized air through the body.

12. The multi-path spray gun of claim 11 wherein the trigger is coupled to the air valve such that trigger actuation allows air to flow from the source of pressurized air through the body.

13. The multi-path spray gun of claim 9 wherein the fluid valves are needle valves.

* * * * *